United States Patent [19]

Robinson

[11] Patent Number: 4,916,789

[45] Date of Patent: Apr. 17, 1990

[54] VALVE STEM CONSTRUCTION

[75] Inventor: Joseph H. Robinson, Alexander City, Ala.

[73] Assignee: Robinson Foundry, Inc., Alexander City, Ala.

[21] Appl. No.: 337,673

[22] Filed: Apr. 13, 1989

[51] Int. Cl.[4] ..... F16K 1/02

[52] U.S. Cl. ..... 29/890.123; 29/890.127

[58] Field of Search ..... 29/157.1 R, 157.1 A, 29/156.7 B; 137/15

[56] References Cited

U.S. PATENT DOCUMENTS

| | | | |
|---|---|---|---|
| 1,209,145 | 12/1916 | Grabill . | |
| 1,483,631 | 2/1924 | Forbes . | |
| 1,954,643 | 4/1934 | Neuhaus | 251/62 |
| 2,842,336 | 7/1958 | Johnson | 251/330 |
| 3,182,362 | 5/1965 | Dobrikin | 22/203 |
| 3,252,793 | 5/1966 | Hesse | 75/157.5 |
| 3,376,118 | 4/1968 | Odenthal | 29/183.5 |
| 4,093,018 | 6/1978 | Trumbauer | 164/32 |
| 4,243,070 | 1/1981 | Jackson | 137/510 |
| 4,423,646 | 1/1984 | Bernhardt | 76/108 |
| 4,512,550 | 4/1985 | Kocher | 251/214 |
| 4,527,771 | 7/1985 | Yeary | 251/118 |
| 4,532,957 | 8/1985 | Battle | 135/375 |
| 4,541,608 | 9/1985 | Forester | 251/77 |
| 4,621,790 | 11/1986 | Balter | 251/305 |
| 4,658,848 | 4/1987 | Meyer et al. | 137/72 |
| 4,660,591 | 4/1987 | Brown et al. | 137/312 |
| 4,705,062 | 11/1987 | Baker | 137/315 |
| 4,712,605 | 12/1987 | Sasaki et al. | 165/516 |

FOREIGN PATENT DOCUMENTS

| | | |
|---|---|---|
| 154449 | 9/1983 | Japan . |
| 124047 | 6/1987 | Japan . |
| 151242 | 7/1987 | Japan . |
| 435065 | 6/1975 | U.S.S.R. . |
| 623643 | 8/1978 | U.S.S.R. . |
| 2085777 | 5/1982 | United Kingdom . |

*Primary Examiner*—John Fox

*Attorney, Agent, or Firm*—Banner, Birch, McKie & Beckett

[57] ABSTRACT

A valve stem formed by evaporative pattern (or lost foam) casting a hollow or solid rod member inside of the elongated outer member. Since the stem is thereby cast to near net shape, little machining is required to finish it. The elongated member can have on its outer surface coarse square threads, a thrust ring, a flattened transition and a retaining nut threaded end. The rod member can advantageously be made of a material that is stronger and less expensive than that of the copper base alloy of the elongated member.

8 Claims, 1 Drawing Sheet

VALVE STEM CONSTRUCTION

BACKGROUND OF THE INVENTION

The present invention relates to valve stems, their constructions, and methods of manufacturing them. It more particularly relates to the construction of valve stems used in gate valves.

Valve stems are typically made of copper based alloys machined from bar stock, castings or forgings. The finished valve stem typically includes a coarse square (acme style) thread, a thrust ring, and a flattened transition to accept a handwheel or wrench, and a standard threaded end for accepting a retaining nut thereon. A number of machining steps are required to produce the finished valve stem. The prior art manufacturing methods are thus equipment and labor intensive and accordingly expensive.

Many types of valve stems are known, and examples thereof are shown in the following U.S. patents:

| U.S. Pat. No. | Patentee |
|---|---|
| 1,209,145 | Grabill |
| 1,483,631 | Forbes |
| 1,954,643 | Neuhaus |
| 2,842,336 | Johnson |
| 4,243,070 | Jackson |
| 4,512,550 | Kocher |
| 4,527,771 | Yeary |
| 4,532,957 | Battle |
| 4,541,608 | Forester |
| 4,621,790 | Balter |
| 4,658,848 | Meyer |
| 4,660,591 | Brown |
| 4,705,062 | Baker |

(Each of these patents and any other publications mentioned herein are hereby incorporated by reference in their entireties.) As will be apparent, the present invention can be adapted to form generally any of the valve stem configurations disclosed in these patents.

SUMMARY OF THE INVENTION

Accordingly, it is a principal object of the present invention to provide an improved valve stem construction.

It is a further object of the present invention to provide an improved technique for manufacturing valve stems which requires reduced amounts of machining thereof.

It is a still further object of the present invention to provide an improved valve stem construction which can be manufactured less expensively.

Another object is to provide an improved valve stem construction which is mechanically stronger than prior art valve stems.

Directed to achieving these objects, an improved valve stem construction is herein provided. The valve stem is cast to net or near net shape using the lost foam or evaporative pattern casting process. A hollow or solid cylindrical insert is cast inside of the valve stem. This insert can be incorporated inside the plastic foam pattern when the plastic foam is molded or inserted into the plastic foam prior to the metal casting operation. The degree of fusion between the insert and the outer elongated member, which can be of cast copper base alloy, can be controlled, for example, by varying the texture of the outer surface of the insert.

Other objects and advantages of the present invention will become more apparent to those persons having ordinary skill in the art to which the present invention pertains from the following description taken in conjunction with the accompanying drawings.

DETAILED DESCRIPTION OF PREFERRED EMBODIMENTS OF THE INVENTION

Figure 1:
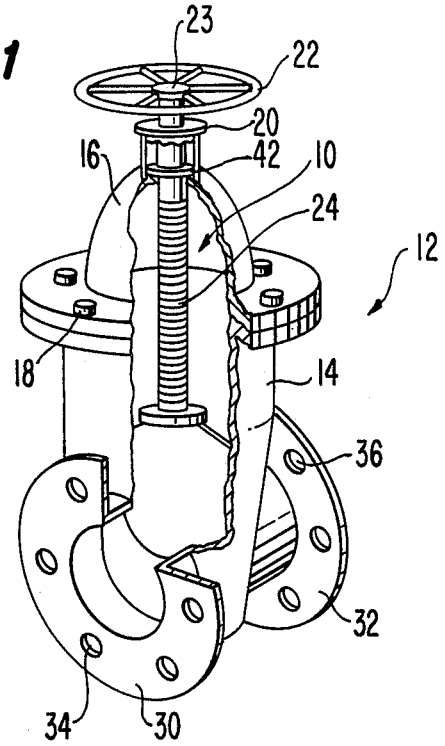
FIG. 1 is a perspective view of a valve incorporating a valve stem of the present invention with portions of the valve broken away for the sake of illustration.

Referring to FIG. 1 a valve stem of the present invention is illustrated generally at 10. The valve stem for purposes of explanation and to illustrate a working environment thereof is shown installed in a valve shown generally at 12. Valve 12 includes a valve body 14 and a bonnet 16 bolted thereto by bolts 18. The valve body 14 has an upper opening, and the valve stem 10 extends up through the opening, a seal plate 20 and a handwheel 22 (or actuating handle or wrench). A retaining nut 23 is then threaded onto the end of the valve stem 10 to retain the handwheel 22 thereon. The lower threaded portion 24 of the valve stem 10 threads into a stem nut 26. The stem nut 26 in turn is attached at the top of a gate or disk 30 such that as the valve stem 10 is rotated by turning the handwheel 22, the disk 30 is guided controllably up or down within the interior chamber of the valve body 14 and relative to the flow path. The body 14 has end flanges 30, 32, each having bolt holes 34, 36, respectively, for securing the body 14 to and between flanged pipes (not shown) which define the flow path. Further disclosures of the construction of various valves of this invention are provided in the above-listed patents and particularly in U.S. Pat. No. 4,423,646.

Figure 3:
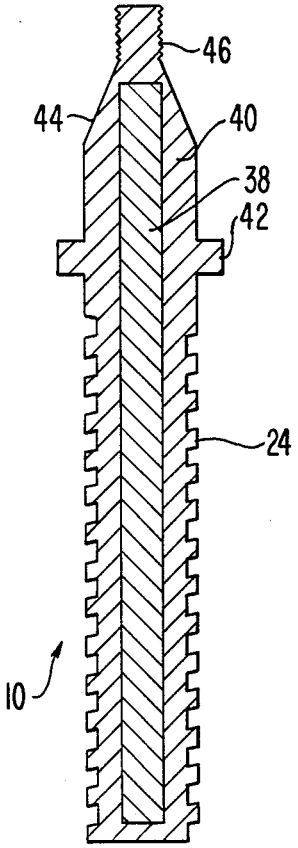
FIG. 3 is a cross-sectional view of the valve stem of FIG. 2.

The valve stem 10 is formed by the evaporative pattern or lost foam casting process, as will be described in greater detail later, with a cylindrical insert 38 cast inside of an outer elongated member 40. Thus, as is best shown in FIG. 3, the insert 38 is centrally located and longitudinally disposed inside of the outer elongated member 40. The insert 38 is cylindrically shaped and can be formed either as a solid rod or a hollow tube.

Figure 2:
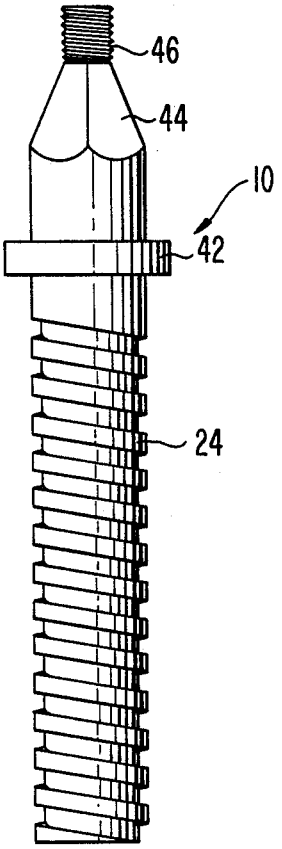
FIG. 2 is an enlarged elevational view of the valve stem of FIG. 1 illustrated in isolation.

The outer elongated member 40 is configured so that its outer surface includes, for example and as best shown in FIG. 2, the coarse threaded portion 24, a thrust ring 42, a flattened portion 44 for accepting a wrench, actuating handle or the handwheel 22, and an end threaded portion 46 for receiving thereon the retaining nut 23. Other stem configurations are of course within the scope of this invention, and examples thereof are shown in the previously-listed patents.

The preferred design is to fully enclose the insert 38 within the outer elongated member 40. The length of the insert 38 can be adjusted to provide the desired enhanced stem construction, but will ordinarily be fully enclosed within the outer elongated member 40. The insert 38 can be as long as the length of the stem outer elongated member 40 minus one-half inch, thereby allowing one-quarter inch of the stem outer member at each end thereof. The valve stem 10 will typically be four, six or eight inches long.

The evaporative pattern casting process is a relatively recent development in the metal casting industry and is described by H. F. Shroyer in U.S. Pat. No. 2,830,343 and in Japanese Publication 151,242 (Application No. 60-295557). There are seven basic steps used in making a casting with this process. These steps are: (1) expanding the polymer beads and aging them for molding; (2) injection molding the beads to make a foam pattern; (3) assembling the patterns into clusters; (4) applying a refractory slurry coating to the clusters; (5) investing the clusters in sand (which has no binders in it) using vibration to encourage sand flow and compaction; (6) pouring the metal into the cluster, evaporating the polymer foam and replacing it with the metal; and finally (7) removing the cast cluster from the sand and cleaning the casting.

This evaporative pattern casting process allows the development of cast metal objects which can be made with fewer design constraints from the casting process. This process also results in castings having excellent surface finishes with few, if any, extraneous metal fins or flash parts. Dimensional accuracy of the cast item (the valve stem 10) is also enhanced. A variety of metals can be cast and relatively complex parts incorporating cast-to-size features not feasible for production by conventional sand casting methods can be made.

The insert 38 can be incorporated inside the plastic foam pattern (not shown) for the outer elongated member 40 when the plastic foam is molded, or it can be inserted into the plastic foam prior to the metal casting operation.

The outer elongated member 40 is preferably cast from a copper base alloy. Examples thereof include silicon brass and bronze, such as (1) copper alloy numbers 879, 872, 874, 875, 876 and 878, (2) manganese bronze, such as copper alloy numbers 864, 865, 867, 861, 862, and 863, (3) aluminum bronze, such as copper alloy numbers 952, 953, 954, 955, 958, 956 and 957, (4) copper nickel alloys such as copper alloy numbers 973, 974, 976, 978, 962 and 964 (ASTM B584-73-947), and (5) specialty alloys such as CA 994 and 995 and that of U.S. Pat. No. 3,252,793. The present process is thus applicable to a very broad base of alloys and other metals may be produced.

The solid or hollow insert 38 can be formed of materials such as (1) cast iron including gray, nodular and/or malleable, (2) steel, (3) bronze or copper based, (4) any other metal, or plated metal, which can be used to advantage, and (5) ceramic rods, plated or unplated, alumina, aluminosilicates, zirconium silicates or other such ceramics, including nitrides.

The insert 38 thus can be formed of a material having a higher strength than that of the copper based alloy used for the outer elongated member 40. The strength and rigidity of the valve stem 10 can thereby be improved and controlled. Similarly, the material used for the insert 38 can be less expensive than that of the relatively expensive copper base metal of the outer elongated member 40. The metal of the insert 38 can be selected to cost a mere twenty percent, for example, of the copper based alloy that it essentially replaces.

Additionally, the fusion between the insert 38 and the outer elongated member 40 can be controlled. In other words, the contact zone between the insert 38 and the outer elongated member 40 can be varied and controlled from full fusion between them to intimate contact without fusion. The fusion can be controlled using such techniques as surface texturing of the insert 38, plating, cladding or fluting with fins. Other fusion control techniques as would be apparent to one skilled in the art are also within the scope of this invention.

This evaporative pattern casting process for the valve stem 10 with insert 38 of this invention allows for improved control over the grain structure in the cast copper base material of the outer elongated member 40. The rapid solidification resulting from the presence of the insert 38 improves the soundness of the section and produces a fine grain structure in the casting. This improvement over the usual large columnar or dendritic graphs normally present in central sections of valve stem castings results in mechanical strength properties closer to optimum for the cast copper base material.

The lost foam casting method with the insertion of the rod or cylindrical insert 38 inside of the valve stem outer member 40 of the present invention thus has a number of unique benefits. The net or near net shaping capabilities reduce the amount of machining required to produce the finished valve stem 10. This method can cast the square ("acme" type) threads 24 to net or near net shape. The thrust ring 42 and flattened transition 44 can similarly be cast to net or near net shape. The standard threaded end 46 can be cast to the desired diameter for threading thereby eliminating the rough machining operation. This reduction in the required machining for the valve stem 10 reduces the costs of the cutting tools, the cycle time for machining thereby affording labor savings, and the costs of capital for equipment.

This finished valve stem 10 also has improved mechanical strength properties. As previously discussed, this results from the use of stronger materials for the insert 38, improved grain structure, and controlled fusion.

From the foregoing detailed description, it will be evident that there are a number of changes, adaptations and modifications of the present invention which come within the province of those skilled in the art. However, it is intended that all such variations not departing from the spirit of the invention be considered as within the scope there of as limited solely by the claims appended hereto.

What is claimed is:

1. A method of constructing a valve stem comprising: evaporative foam casting to at least near net shape an elongated member having an outside valve stem surface including a threaded portion and an engagement surface turning portion, and with a rod member of substantially the same length as and of a different material than that of the elongated member cast in the elongated member.

2. The method of claim 1 further comprising molding a plastic foam for said casting step.

3. The method of claim 2 further comprising incorporating the rod member in the pattern of the plastic foam before said molding step.

4. The method of claim 2 further comprising inserting the rod member into the plastic foam before said casting step and after said molding step.

5. The method of claim 1 further comprising controlling the fusion between the rod member and the elongated member.

6. The method of claim 1 wherein said elongated member is made of a copper base alloy and the rod member comprises a material which is stronger than the copper base alloy.

7. The method of claim 1 wherein said outside valve stem surface includes a valve stem thrust ring disposed between the threaded portion and the engagement surface turning portion, and the rod member is fully enclosed in the elongated member.

8. The method of claim 1 wherein said evaporative foam casting step casts the elongated member to net shape.

* * * * *